United States Patent [19]

Reutter

[11] Patent Number: 5,071,020

[45] Date of Patent: Dec. 10, 1991

[54] RADIATOR NECK WITH RADIATOR COVER CAP

[75] Inventor: Heiner Reutter, Waiblingen, Fed. Rep. of Germany

[73] Assignee: Reutter Metallwarenfabrik GmbH, Waiblingen, Fed. Rep. of Germany

[21] Appl. No.: 438,350

[22] Filed: Nov. 16, 1989

[30] Foreign Application Priority Data

Nov. 23, 1988 [DE] Fed. Rep. of Germany ..... 8814599
Feb. 16, 1989 [DE] Fed. Rep. of Germany ..... 8901826

[51] Int. Cl.[5] ..... B65D 51/16

[52] U.S. Cl. ..... 220/203; 220/300; 220/301; 220/303; 220/DIG. 32

[58] Field of Search ..... 220/203, 293, 295, 298, 220/303, DIG. 32, 300, 301, 297

[56] References Cited

U.S. PATENT DOCUMENTS

| | | | |
|---|---|---|---|
| 1,456,333 | 5/1923 | Nelson | 220/295 |
| 1,550,302 | 8/1925 | Zarobsky | 220/295 |
| 3,878,965 | 4/1975 | Crute | 220/295 |
| 4,498,599 | 2/1985 | Avrea | 220/203 |
| 4,511,056 | 4/1985 | Reutter | 220/204 |
| 4,762,244 | 8/1988 | Ziegler | 220/203 |

*Primary Examiner*—Stephen Marcus
*Assistant Examiner*—Nova S. Tucker
*Attorney, Agent, or Firm*—Toren, McGeady & Associates

[57] ABSTRACT

In order to attach a radiator cap 1 by means of a bayonet lock 4, 5 at a radiator neck 2 and to be able herein to install a completely assembled pressure relief valve 35 and vacuum relief valve 40 at the radiator cap 2, a lifting counterpart curved surface 23 is provided so as to be spaced axially from each bayonet engaging curved surface 5. In addition a counterpart cam 26 is at least indirectly connected with each bayonet cam 4, especially if it is manufactured in one piece, which counterpart cam in connection with the lifting counterpart curved surface 23 causes the necessary lifting of the radiator cap 1 counter to the installation direction when the radiator cap 1 is opened. Furthermore, the lifting counterpart curved surface 23 is expediently fastened at plastic part, according to one embodiment of the invention, constituting the stub or neck of a compensation vessel or container 45. This stub is preferably fabricated to form one piece with the vessel 45. This need however only be the inner portion 44 of the stub 2, which is complemented by an outer radiator neck portion 46 or 47 so as to form the radiator neck 2.

25 Claims, 4 Drawing Sheets

FIG. 7
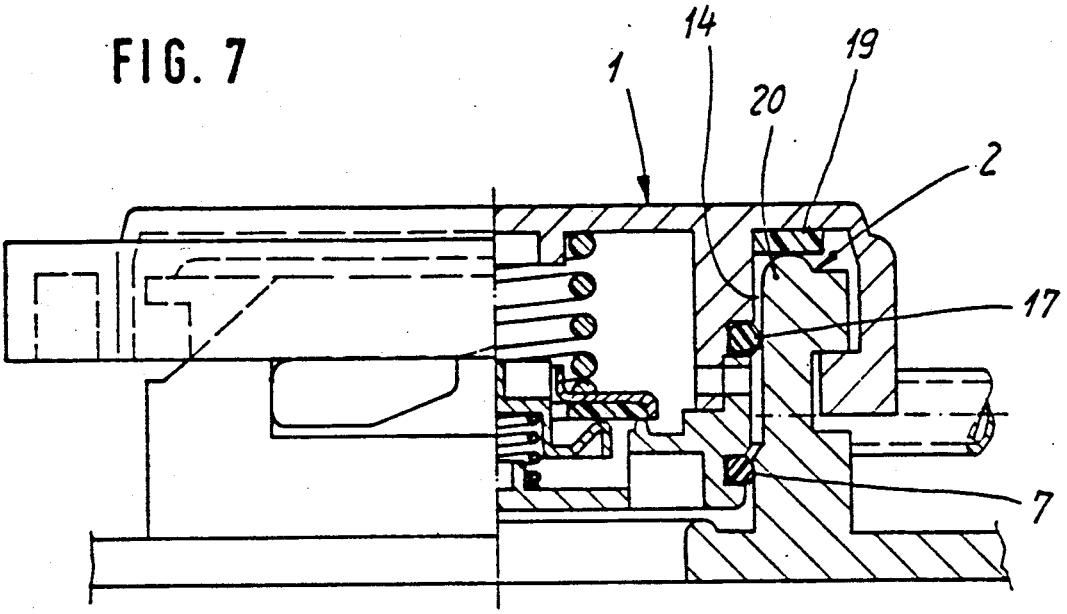
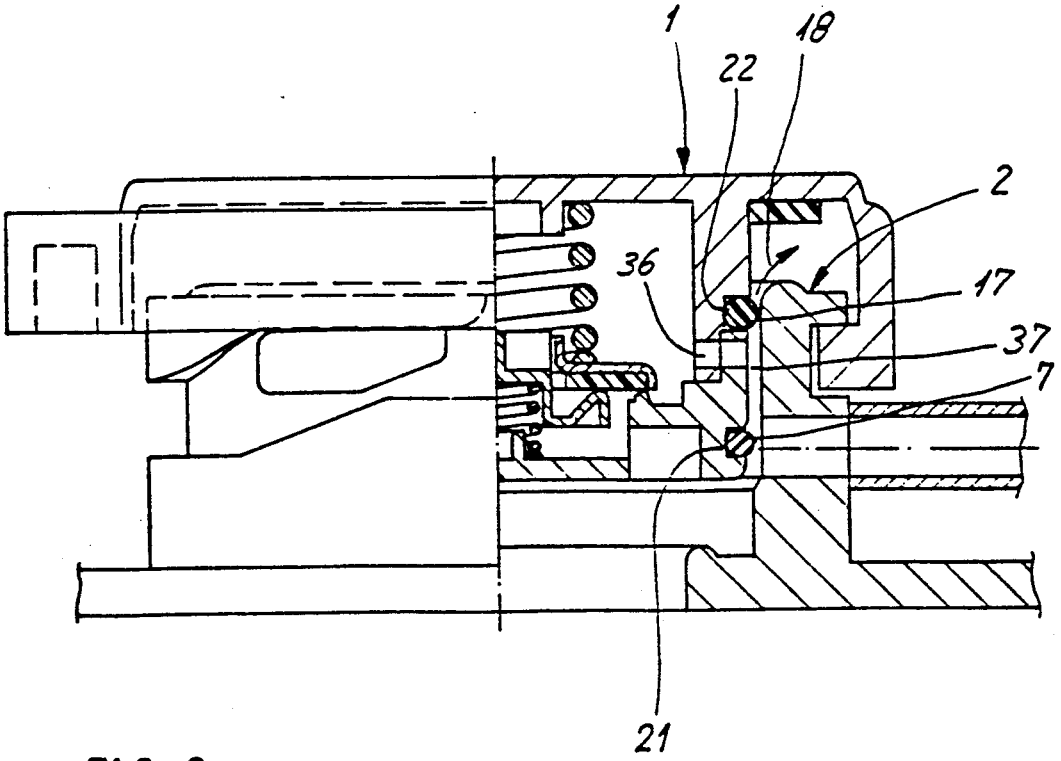
FIG. 8

RADIATOR NECK WITH RADIATOR COVER CAP

The invention is directed to a radiator neck with a radiator pressure cap comprising a pressure relief valve and a negative pressure or vacuum relief valve, as is typically used in engine cooling systems.

BACKGROUND OF INVENTION

Radiation pressure valves can be sealed with respect to the radiator neck by means of at least two sealing rings of which at least the inner one is a first O-ring, with the radiator neck comprising at least one radial outlet aperture located between the two sealing rings when the cap is completely closed. If the pressure relief or blow-off valve opens, cooling liquid and/or steam exits through the outlet aperture. If the complete pressure relief valve, meaning its sealing organ and its valve seat, is fastened to the radiator cap then the installation of the valve seat at the radiator neck is not required as far as the operability of this radiator cap is concerned. The same applies also to the vacuum relief valve. One can then install, check and if required adjust the pressure relief valve as well as the vacuum relief valve completely at the radiator cap in the workshop. The radiator cap must be sealed against the radiator neck at a suitable point so that, when the radiator cap has been put into its completely closed position, the cooling liquid or the steam formed therefrom cannot escape past the radiator cap between it and the radiator neck. On the other hand however a hydraulic connection towards the outside is necessary if the pressure relief valve opens, so that the cooling agent subjected to excessive pressure can exit from the neck. For this reason the inner seal with reference to the free radiator neck end must be arranged in such a way that the cooling liquid subjected to excessive pressure can basically only flow out through the pressure relief valve. On he other hand one must however assure that the cooling agent flowing out under excessive pressure can escape only through the outlet aperture of the radiator neck and not possibly along another travel path from the radiator neck. This requires the provision of the second sealing ring, wherein the outlet aperture of the radiator neck for the cooling agent flowing out under excessive pressure lies between these two seals. The second seal can possibly rest at the free radiator neck end, and be mounted to the inner face of a closing lid of the filler cap. In this case it can be a gasket. The inner seal in this type of construction is an O-ring retained at the radiator filler cap. Instead of the mentioned gasket a second O-ring can be fastened at the filler cap. It is even theoretically conceivable to provide in addition the mentioned gasket as a supplement to these two O-rings. At least in the normal case this gasket has no significance as far as a perfect sealing is concerned. It enters at the most into operation if the middle seal of these three seals fails.

The known filler cap is held upon the radiator neck by means of a threaded connection, and it comprises a cylindrical extension provided with a male thread, while the radiator neck is equipped with a matching female thread. The one or the several O-rings are located further inward in the neck as far as this thread is concerned.

It is also known to retain a radiator cap at a radiator neck by means of a bayonet thread, however in this case the radiator neck consists of metal at least at its end connected with the radiator cover cap. Apart from that no complete pressure relief valve is then present at the filler cap, rather only the valve head of same. The assigned valve seat is fastened at the metallic radiator neck, preferably it is molded therein. An accurate presetting of the pressure relief valve then becomes impossible in actual practice, because a radiator cap is normally supplied separately from the filler neck and it is therefore not known to begin with which specific filler cap will be used with which filler neck. In this type of construction an unfortunate clash of tolerances can arise.

Modern motor car engines operate at higher pressures and temperatures of the cooling medium. This necessitates tighter tolerances for the response pressures. This tolerance can be assured only if the pressure relief valve and the vacuum relief valve are completely located at the filler cap. On the other hand no possibility has been found so far of retaining such a filler cap at the radiator filler stub by means of a bayonet type lock.

SUMMARY OF INVENTION

A principal object of the invention is a radiator neck with filler cap of the previously described type in which the radiator filler cap can be fastened at the radiator neck, be provided with a complete pressure relief and vacuum relief valve, and also eliminate a threaded connection between the radiator neck and radiator filler cap.

In accordance with one aspect of the invention, the radiator cap and neck are provided with a bayonet-type lock comprising surfaces which engage and cooperate in lifting the cap off the neck when the cap is rotated toward its open position.

Preferably, the cap has two or three sealing rings, of which at least the inner one is an O-ring. This O-ring rests with radial compression at the engaged filler neck wall, which compression is very high particularly in pressurized cooling systems. Therefore, the filler cap can, when under excessive pressure and even after relief of the excessive pressure, be lifted up or removed from the filler neck only with a great deal of force. In the known threaded connection, this required axial force is applied when the filler cap is screwed out. In case of a bayonet lock of the conventional type no corresponding axial force arises. It must therefore be generated by a correspondingly strong pull at the filler cap. This can entail a consequential tilting and can lead to damage to the O-ring.

The use of a bayonet-locking cap is now possible for the first time because of the fact that a lift-producing counterpart opposed curved surface is also located at the filler neck in accordance with the invention, which in cooperation with an opposing or counterpart camming surface can form a lifting device for the filler cap, which during opening by a rotary movement pushes the radiator cap outwards until the inner O-ring has been released from contact with its wall or in case of a conical wall the compression against this wall has been overcome.

A bayonet cap or a quarter turn cap has the advantage compared to a rotary cap, in that one finds or feels the closed rotary end position with certainty due to the existing rotary stops, which is not assured with certainty in case of a radiator filler cap which is threaded on. Especially users capable of a somewhat smaller force, or timid users, who do not want to damage the filler cap, or also somewhat careless users, who do not pay any attention to the circumstance that the filler cap is not completely turned closed, may fasten the threaded type filler cap not tightly enough; this then leads, in case of sealing between the radiator neck and filler cap at the free neck end by means of a gasket, to the cooling system not developing sufficient pressure. In addition the coolant can inadvertently escape.

In the radiator neck with radiator cap of the invention, this cannot happen, because the bayonet lock as has been stated clearly signals to the user the location of the closed rotary end position. This also has the advantage that one is not tied to specific materials for the radiator neck and the radiator cap, so long as the required strength, corrosion resistance and temperature tolerance are maintained.

A further feature of the invention provides that the bayonet curved surface or cam and the lift counterpart cam end at a common rotary stop viewed in the closing rotational direction. This does not necessarily mean that when the bayonet lock is opened, the lift counterpart curved surface must enter into action in the sense of producing a lifting effect on the radiator cap. It depends upon the shaping of the lifting counterpart curve when and to what extent this can be the case; by shaping we mean the respective slope with respect to a plane perpendicular to the radiator neck axis.

Another embodiment of the invention is characterized by each bayonet engaging curved surface and each counterpart curved surface forming an external groove extending in a circumferential direction of the neck, which external groove opens towards the outside in the radial direction of the neck and which discharges or opens axially outwards at the free neck end. The width of this outlet, viewed in a circumferential direction of the neck mouth, corresponds at least to the length of the bayonet cam and the counterpart cam. The bayonet cam with the lifting counterpart cam slides through this mouth into the external groove when the radiator cap is placed in position, and then the rotary cap can be rotated if the radiator cap is to be fastened at the radiator neck. The removal is accomplished in the reverse manner. The bayonet cam embraces the neck portion comprising the bayonet engaging curved surface in exactly the same manner as is known from the conventional radiator caps fabricated from sheet metal, meaning from the top as well as from the outside inwards, referred to the mentioned external groove of the radiator neck.

In accordance with another aspect of the invention, the bayonet curved surface is provided with an inclined edge, and the lifting cooperating curved surface on the neck comprises a first approximately flat segment adjacent the closed position stop, an inner lifting segment, a second approximately flat segment, and an outer lifting segment.

If the bayonet cam with the mating cam proceeding from the rotary stop is moved along the first partial segment of the lifting counterpart surface which is approximately flat and if the bayonet cam rises at least in this region, then, because of the retention or holding action of the one or the several O-rings the bayonet cam can somewhat separate from the bayonet cam engaging curved surface in the axial direction by the amount of the bayonet curved surface slope or incline and the corresponding rotary angle. The inner lifting segment of the lift counterpart curved surface causes a lifting up of the matching cam and of the bayonet cam and with this of the entire radiator cam in the removal or opening direction. The inner lifting segment is now dimensioned in such a way that it lifts the radiator cap to such an extent that the inner O-ring is released from contact with its wall. Due to this, the excess pressure in the cooling system can be relieved past the radiator gap outwards. This corresponds to the known pre-snap-in or intermediate or partially closed position. After an additional opening rotary motion, the matching cam reaches the outer lift segment of the lifting matching curved surface. At its outer end at the latest a possibly existing second O-ring has been released from contact with the cylinder wall at least sufficiently that the cap can be pulled off without having to exercise any particular effort.

Other important embodiments and advantages of the invention result from the claims as well as the following description of embodiment examples.

SUMMARY OF DRAWINGS

The invention is now described with particularity with the help of the accompanying drawings. The drawings show various embodiment examples of the invention, wherein:

FIG. 7 is a view similar to FIG. 5 of another variant of the invention;

FIG. 8 is a view similar to FIG. 6 of the variant of FIG. 7;

DETAILED DESCRIPTION OF PREFERRED EMBODIMENTS

Figure 1:
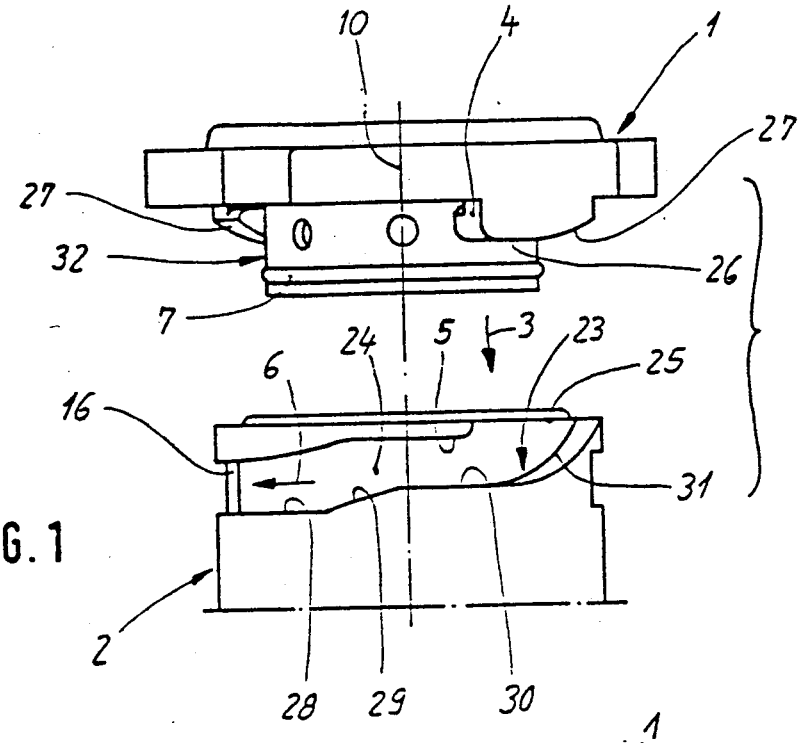
FIG. 1 is a side view of the free end of a radiator neck with a radiator cap separated therefrom, but which can be connected with said radiator neck, in accordance with the invention.
Figure 2:
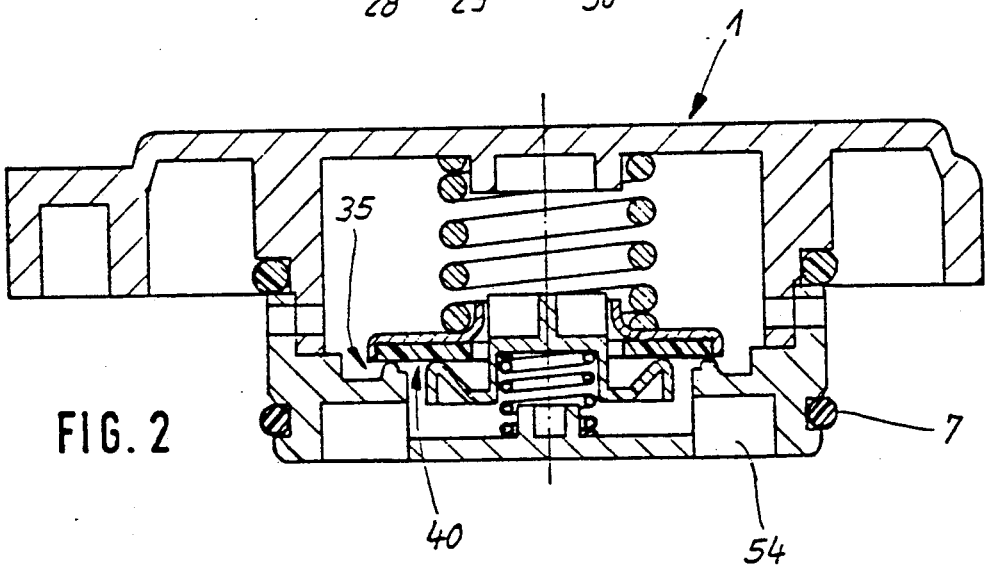
FIG. 2 is a magnified illustration of a vertical section of another embodiment of radiator cap of the invention.

A radiator cap 1 and a radiator neck 2 in accordance with the invention are connected with each other by a bayonet lock. The radiator cap 1 is pressed in the installation or closing direction 3 upon the radiator neck 2 until its bayonet cam or cams 4 come to lie beneath the starting edge of the respectively assigned bayonet engaging curved surface 5, so that subsequent rotation in the closing direction of the arrow 6 becomes possible. The bayonet cam 4 slides in a known manner along the bayonet curved surface 5 falling towards the bottom, which produces a lowering motion of the radiator cap 1 which is superimposed upon its rotational motion. The radiator cap 1 comprises in the embodiment example in FIG. 1, a sealing ring 7 designed as an O-ring at its front end from the installation direction 3. This O-ring rests or engages as can be discerned from FIG. 5 for instance at a cylindrical inner surface 8 at least if the bayonet lock is completely closed and thus seals at this point the gap space 9 between the radiator cap 1 and the radiator neck 2.

Each of the two bayonet curved surfaces 5 of this embodiment example extend as shown for instance in FIG. 1 in approximately a plane perpendicular to the geometric axis 10 of the radiator neck 2 or at most slightly inclined thereto. The inclined or steeper segment or extension that follows causes the pulling inwards of the radiator cap 1 in the direction of the arrow 3. The so-called pre-snap-in or intermediate closed position is attained (FIG. 6) at the transition of these two curved segments. At that position, the sealing ring 7 does not yet rest at the cylinder inner surface 8; this sealing ring constitutes a first O-ring 7 in case of two sealing rings designed as O-rings. Due to this arrangement, a flow connection between the inside of the radiator and the outer atmosphere or an outflow tube 11 through a radial outlet aperture 12 of the radiator neck 2 is still open. In the embodiment example of FIG. 6, the radiator neck inner wall is thinned down in a stepped manner in the region of the radiator cap 1. The transition occurs for instance by an intermediate cone 13. The diameter of the remaining bore portion 14 is chosen in such a way that the first O-ring 7 cannot engage same. Proceeding from the closed position of the radiator cap 1 (for instance FIG. 5) it is possible to relieve any excess pressure inside of the cooling system through the radial outlet aperture 12 after a partial opening rotation up to the pre-snap-in position (FIG. 6). After the pressure has been reduced, the radiator cap is completely opened by rotation counter to the arrow 6 and then lifted off the radiator neck 2 counter to the arrow 3. The rotation in the closing direction of the arrow 6 can be performed until the front edge 15, viewed in the closing rotational direction of the bayonet cam 4, engages an assigned rotary end stop 16 of the radiator neck 2.

In the embodiment example in FIGS. 7 and 8, a second O-ring 17 is provided in addition to the first O-ring 7. It rests already at the bore portion 14 on the radiator neck 2, which bore portion has the larger diameter, when the radiator cap 1 is placed upon the upper end of the radiator neck 2. Because of this the steam cannot flow out in the sense of the arrow 18 through the outlet aperture of the radiator neck 2 in the pre-snap-in position (FIG. 8). A third sealing ring 19 is provided additionally in the embodiment example in FIGS. 7 and 8, which is designed in a known manner as a gasket and which rests upon the bead-like mouth of the radiator neck 2 when the bayonets are completely closed or which is pressed against said beads in a sealing manner. In the pre-snap-in position (FIG. 8), this seal is unloaded or lifted off the mouth opening. It is pointed out at this time that, instead of the step-like widening bore of the radiator neck 2, a bore which tapers conically from the outside to the inside can also be provided, and the cone can in this case be selected in such a way that in the case of two O-rings the second O-ring 17 rests at the radiator neck wall 2 in a sealing manner also in the pre-snap-in position. The O-ring grooves are designated with 21 and 22.

The special feature of the combination of the invention of radiator cap 1 and radiator neck 2 consists in that a lift counterpart curved surface 23 is located opposite each bayonet engaging curved surface or cam 5. Both together form because of their actual spacing an external groove 24 extending in a circumferential direction of the neck. The bottom of the groove can be seen in FIG. 1. In addition each outer groove opens or discharges at the free radiator neck end, wherein the groove discharge in FIG. 1 is designated with the numeral 25. Its length measured in a circumferential direction corresponds to the length of the bayonet cam 4.

Each bayonet cam 4 is connected with an opposite or counterpart cam 26. It is directly connected, or, in case of fabrication from plastics material, it is fabricated to form one piece or be integral therewith. The counterpart or opposing cam 26 is formed by the surface or edge of the assigned bayonet cam 4 facing in the installation direction 3 of the radiator cap 1. This countercam 26 drops off rearwards viewed in a closing rotational direction 6, as is clarified in FIG. 1 of the drawing. Thus a slide-on incline 27 is formed at this location which has a significance explained below when the radiator cap 1 is opened. The height of the bayonet cam 4 and the countercam 26, together measured in the axial direction, is selected in such a way that both together are not higher than the width of the external groove 24 measured in an axial direction at its narrowest point, with the bayonet engagement at the start of the closing rotational movement being left out of consideration.

It is noted, for instance from FIG. 1, that proceeding from the common rotary end stop 16 of the bayonet engaging curved surface 5 as well as the lifting counterpart curved surface 23, this last-mentioned one to begin with starts with an approximately flat segment 28. Thereupon follows an inner lifting segment 29 which can transit into a second flat segment 30. Viewed in the opening rotational direction there follows by way of a last segment an outer lifting segment 31. This last-mentioned segment can also extend with decreasing slope directly up to the inner lifting segment 29.

After putting the radiator cap 1 on the radiator neck 2 each bayonet of the bayonet lock is closed in a known manner, wherein the bayonet cam 4 cooperates respectively with its assigned bayonet engaging curved surface 5. Because of the high friction between the several O-rings and the assigned wall of the radiator neck 2, the radiator cap 5 remains in its lowest position, viewed in an axial direction, when the bayonets are opened. The bayonets 4 themselves are unable to exert a pulling action counter to arrow 3 upon the radiator cap 1. This is also the reason why hitherto no radiator cap was known which could be retained at the radiator neck by means of a bayonet lock and could be sealed against the radiator neck by means of O-rings.

Only by creating a special lifting device for such a radiator cap is it possible to utilize a bayonet lock with radiator caps sealed by means of O-rings, which bayonet lock offers the advantage of being able to locate a secure rotational end position. During a first rotary opening position, each counterpart cam 26 is moved to begin with along the flat or approximately flat first segment 28 of the lifting counterpart curved surface 23. The bayonet cam moves viewed in axial direction continuously away from the falling portion of the bayonet cam 4 viewed in rotary opening direction. Due to this, the radiator cap 1 does not yet execute any or at least no complete lifting opening motion. Only in cooperation of the slide-on incline 27 with the inner lifting segment 29 does there occur a first partial lifting of the radiator cap 1. The dimensioning is selected in such a way that it does not go beyond the known pre-snap-in position. After the excess pressure has been relieved, the radiator cap 1 is rotated counter to arrow 6; then the slide-on incline 27 coacts with the outer lifting segment 31 and due to this lifts the radiator cap 1 up to such an extent that it can be removed from the radiator neck 2 without having to exert any force or at least without having to exert any application of force worth mentioning.

A feature of the invention is the cooperation of a bayonet lock with a rotary lock acting merely in rotary opening direction, wherein the bayonet lock causes so to speak the sealing by means of one or the several O-rings, while the lifting rotary lock renders this sealing again ineffective in two steps. The straight and inclined curved portions of the bayonet curved surface and the lifting countercurve are dimensioned and cooperate with each other in such a way that when one incline enters into access the oppositely located curved surface cannot hinder the lifting motion resulting therefrom in the direction opposite to the arrow 3.

The radiator cap is provided with a centering lug 32, which in the region of its free end supports the first O-ring 7 and which at the same time constitutes the housing for a known pressure relief valve. The lug 32 consists preferably of plastics material, as does the cover upper portion 33 with the molded thereon bayonet cam 4 and the counterpart cam 26. Both are, as can be for instance discerned in FIG. 6, connected with each other by means of a centering device and are tightly held together in a known way. Each O-ring groove is molded on. The same applies preferably also to the valve seat 34 of the pressure relief valve 35 as well as at least to a radial passage aperture 36 of the valve housing wall located on the outflow side, through which the coolant or steam can pass into the gap space 37 between the centering lug 32 or the valve housing and the radiator neck when the pressure relief valve is open. From there the coolant or steam passes in the explained manner through the radial aperture 12 of the radiator neck 2 into the open air even if the radiator cap 1 is tightly closed.

The closing member of the pressure relief valve 35 is designated with the numeral 38 (FIG. 6) and can be constructed in a known manner. It is spring-loaded by means of a helical compression spring 39. The vacuum or negative pressure relief valve 40 is arranged concentrically thereto. Its closing member 42 biased by spring 41 lies in the embodiment example (FIG. 6) at the common sealing ring 43, which simultaneously constitutes the valve seat of the vacuum relief valve 40. In case of excessive pressure the closing member 38 of the pressure relief valve 35 is lifted upwards in a known manner, while in case of negative pressure the closing member 42 of the negative pressure or vacuum relief valve 40 is displaced downwards and indeed respectively against the resistance of the loading spring 39 or 41.

The portion 44 (FIG. 5) of the radiator neck 2 comprising the lifting counterpart curved surface 23 is located at a compensation container or reservoir 45 in an especially preferred embodiment form of the invention, at least however at an upright portion of such a compensation container or vessel. In modern cooling systems a so-called equalization or compensation reservoir vessel or container is provided in addition to the radiator, which carries the radiator cap and into which one adds the cooling water as well as the cooling additives, such as anti-freeze.

Figure 3:
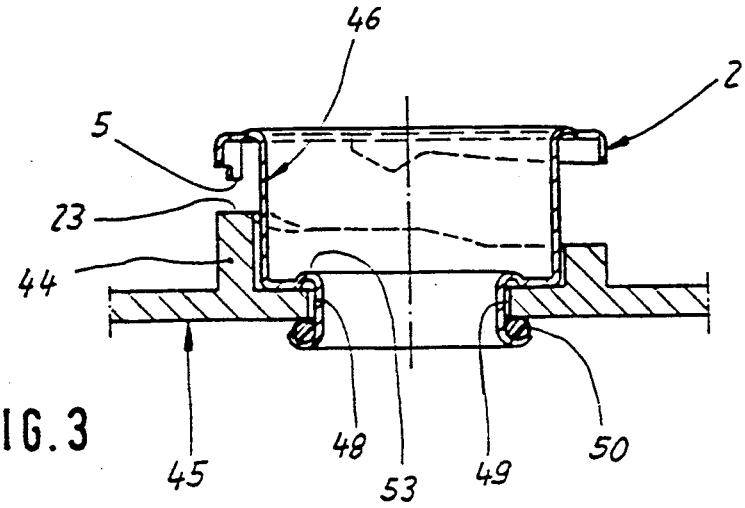
FIG. 3 is a cutout from an upper end of a compensation or equalization container or reservoir with another embodiment of the radiator neck of the invention.
Figure 4:
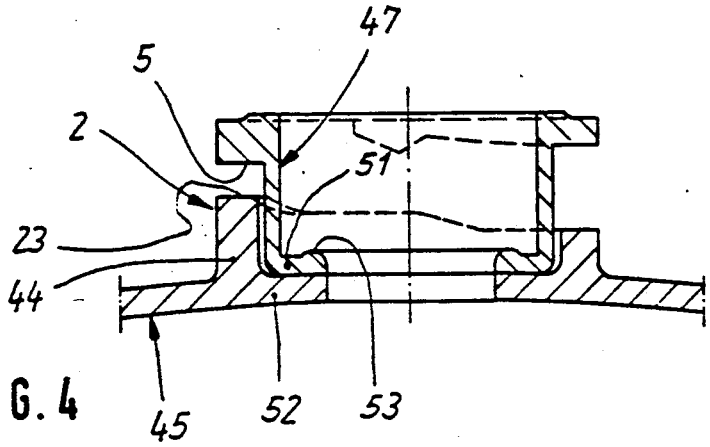
FIG. 4 shows an additional variant of the upper end of a reservoir container with radiator neck in vertical section.
Figure 5:
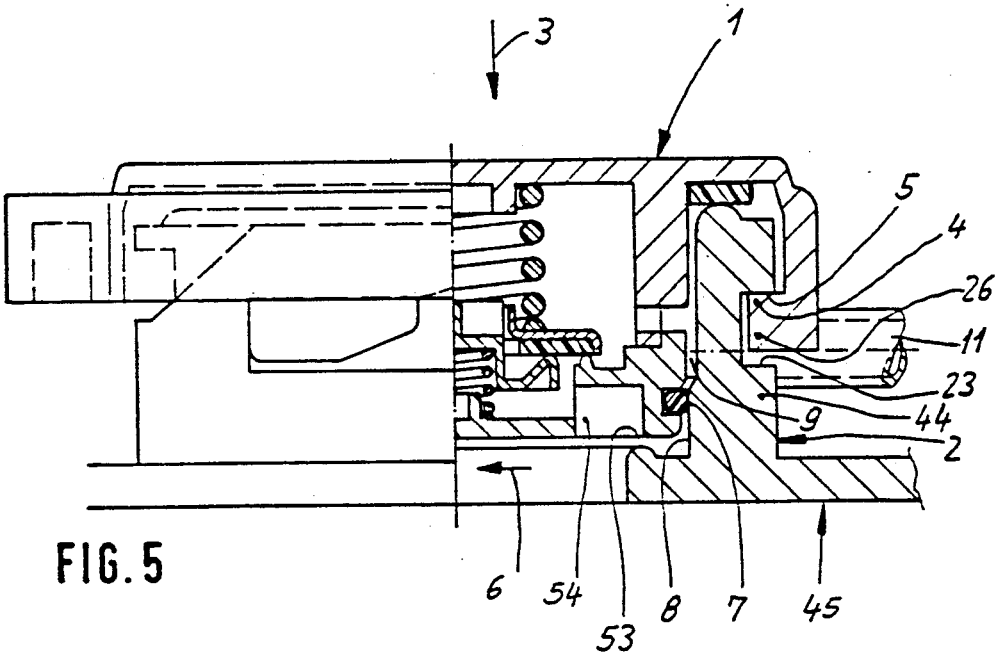
FIG. 5 is a partly cross-sectional side view of a radiator neck molded at a container with the radiator cap placed thereon in the closed end position, with the left half rotated into the picture plane for better illustration of the invention.
Figure 6:
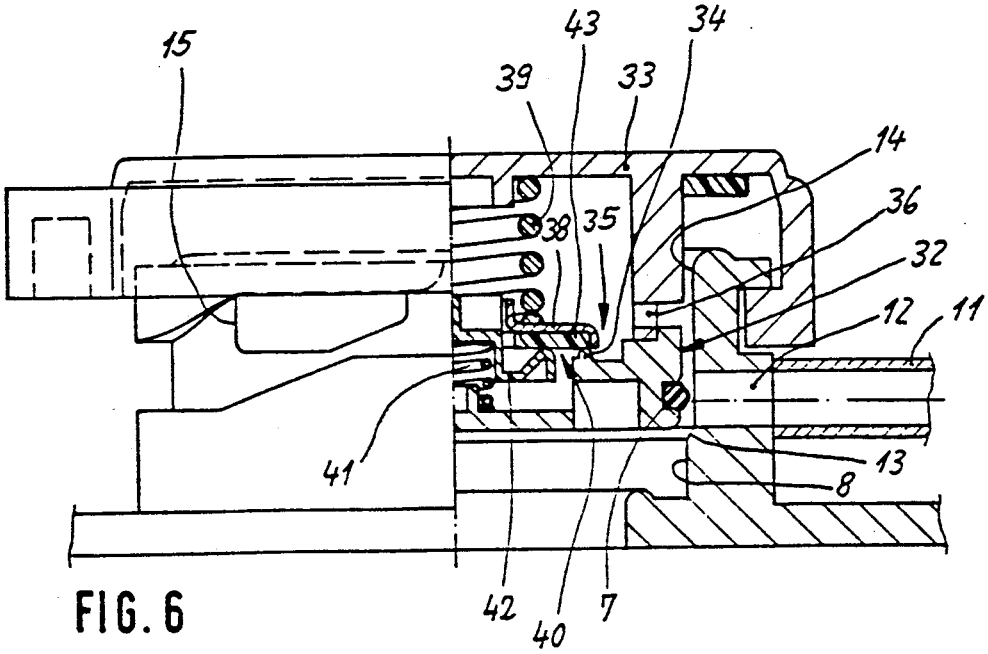
FIG. 6 is a view similar to FIG. 5 showing the cap in the so-called pre-snap-in position.

As FIG. 5 shows one can fabricate not only this part 44 with the lifting counterpart curved surfaces 23 but rather the entire radiator neck 2 in one piece with the compensation vessel 45 or the compensation vessel upper portion. Alternatively, the radiator neck is designed in two parts according to the embodiment forms in FIGS. 3 and 4. While the inner portion of the radiator neck forms the radiator neck part 44 with the lifting-counterpart curved surfaces 23, the bayonet curved surfaces 5 are located at a separately fabricated outer radiator neck portion 46 and 47. The outer radiator neck portion 46 (FIG. 3) is for instance fabricated from sheet metal and in accordance with a known design. It comprises a central tube-like extension 48 by means of which it is fastened by beading or flanging at the central bore 49 of the compensation vessel 45 or of a compensation vessel upper portion, with a sealing or an O-ring 50 interposed between the two parts.

In case the radiator neck and with it also the compensation vessel is entirely fabricated from plastics material, the bayonet curved surfaces 5 in the embodiment example in FIG. 4 are located so to speak at an external collar of a tube-like external radiator neck portion 47, which can also be provided with a perforated base 51 and which is inserted centrally into the tube-shaped part 44. This radiator neck portion 47 is connected in a suitable manner with the wall 52 of the compensation vessel 45, for instance by ultrasonic welding or thrust welding. Naturally such a connection must also be pressure-tight.

In all the previously described embodiment versions of the radiator neck, the valve seat 53 is located so as to be molded to its inner end. In the normal case this has no significance. If however the radiator cap 1 should be lost or fail, then in such an emergency any easily procurable radiator cap can be fastened at the bayonet of the radiator neck 2, if it is equipped with a complete vacuum relief valve. This cap must be equipped with a spring-loaded valve disk, which corresponds to the closing member 38 (FIG. 6). A known pressure relief valve is then produced together with the valve seat 53. Thus this radiator neck 2 can in spite of its special construction be used in an emergency just like a conventional radiator neck. It is again pointed out that the inner portion 44 of the radiator neck does not need to be necessarily connected with or be a component of a compensation vessel, but can be a tubularly-shaped extension of the radiator upper portion or the radiator water box. It is to be sure advantageous and desirable because of fabrication and cost reasons, that the inner portion 44 of the neck 2 consist of plastics, as one also prefers plastics fabrication of the entire radiator cap 1 (with the exceptions of the springs). Polypropylene is preferably used for the compensation vessel, while the cap is expediently prefabricated from polyamide, using a hardy, heat-resistant variant and where one can additionally provide if desired a glass fiber reinforcement or the like.

If the two O-rings 7 and 17 (for instance FIG. 7) are in tight contact with the radiator neck wall and one wants to open the radiator cap 1, then this means a high stress in the two O-rings because of friction in the rotational circumferential direction. In order to preserve the two O-rings, one can rotatably support the portion of the radiator cap 1 which comprises the two O-rings 7 and 17 at the remaining portion of the radiator cap 1 particularly at its upper portion which carries the bayonet cams 4; this feature has not been depicted here.

The medium flowing out under pressure enters into the pressure relief valve 35 through at least one penetration 54 at the free inner end of the radiator neck 2.

Each bayonet cam 4 and its assigned opposite cam 26 form an element movable along the outer groove 24 of the radiator neck, for which reason this outer groove measured in axial direction must be at least as high at each point that the movement of this element when the radiator cap is placed into position and when it is loosened is not interfered with. On the other hand however the height at the individual segments is entirely different, which results from their special shaping and their mutual cooperation. The bayonet curved surfaces have in this case also the otherwise usual task, namely to hold the radiator cap against the neck mouth in such a way, when the radiator cap is turned in the opening direction, that a seal possibly located between the neck mouth and the cover edge is compressed. The bayonet curved surface extending at least partially in an inclined manner is necessary also if O-rings are used for sealing, in order to cause the desired sealing between the radiator cap and the radiator neck.

As one can discern from the previous description of the drawing and preferably from FIG. 1, the bayonet curved surfaces need not necessarily extend across its entire length inclined to the neck mouth or a plane perpendicular to the neck longitudinal axis; rather it is sufficient if only a portion thereof has such an inclination. In FIG. 1 this is the segment extending respectively up to the rotational end stop 16. The segment 28 of the bayonet curved surface reached first by the groove mouth 25 extends in FIG. 1 approximately parallel to the mouth plane. The second flat segment 30 of the lifting counterpart curved surface 23 lies opposite to the initial region of this segment which segment transits smoothly into the outer lifting segment 31. On the left-hand side of the second flat segment 30 there is located the inner lifting segment 29 followed by the first flat segment of the lifting counterpart curved surface 23 up to the rotational end stop 16. Because of this, the two flat segments 28 and 30 of this embodiment lie at different height levels viewed in the axial direction of the neck.

Figure 9:
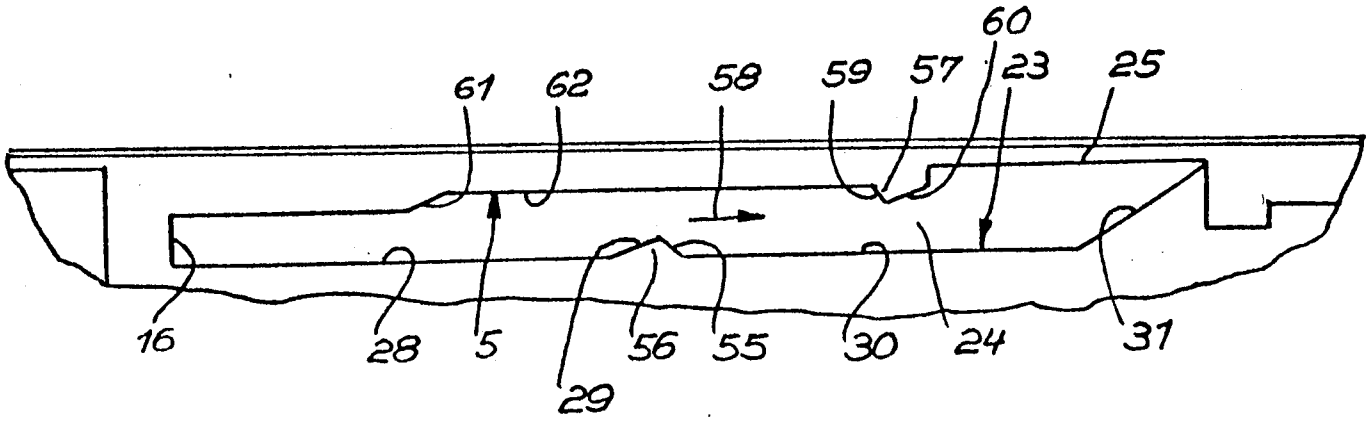
FIG. 9 depicts development of a portion of the radiator neck in the region of the external groove in another variant of the invention.

If one now compares for instance this embodiment with that in FIG. 9, then one will observe that in the FIG. 9 embodiment, the second flat segment 30 is displaced against the lower neck end and that it is located preferably and approximately at the same height level as the first flat segment 28. Due to this, the inner lifting segment 29 transits there not directly into the second flat segment 30, but rather to a flank 55 falling away towards the righthand side. This flank 55 forms together with the inner lifting segment 29 a cam-like lifting element 56.

An auxiliary cam 57 (FIG. 9), facing into the inside of the neck, lies axially opposite to the second flat segment 30 of the lifting counterpart curved surface 23. Such an auxiliary or assist cam 57 is provided at each bayonet curved surface 5. It has special significance when the radiator cap is opened. When the radiator cap 1, which is mostly subjected to high excessive pressure, is opened, then the inner lifting segment 29 causes the release of the first O-ring 27 and with this a connection of the inside of the neck or the radiator with the surrounding atmosphere. In this manner the excessive pressure can be relieved. This process can require a certain time especially with very high excessive pressures and flow passage cross-sections of small dimensions. If one were now to rotate the partially lifted radiator cap very rapidly further in the direction of the open position, then this could lead to the circumstance that the excessive pressure is not yet reduced in the radiator before the cap has been removed or possibly blown away by the excessive pressure. This would then constitute danger of an accident, for instance by scalding or by the projected cap itself.

In order to assure an adequate security also in such a case, the mentioned auxiliary cam 57 exists in the embodiment example in FIG. 9. After the pre-snap-in position has been reached with consequent reduction of excessive pressure, the counter cam 26 strikes against the auxiliary cam 56, whereby a rapid further rotation in the direction of the arrow 58 is prevented. In order to now bring this cap into a rotary position suitable for removal, the auxiliary cam or cams 57 must be overcome. This means that the radiator cap must again execute a downward motion directed towards the radiator. This is impossible or at least not easily possible if excessive pressure is present in the radiator neck. The operator is therefore prevented from executing "a rapid spin" of the radiator cap in the opening direction 58 and the attention of the inattentive operator is drawn by the auxiliary cam 57 to the circumstance that he should not turn the cap further too rapidly; rather he should to begin with await the reduction of the excessive pressure. In order to enable the downward motion of the counterpart cam 26 required in order to overcome the auxiliary cam 57, the second flat segment 30 of the lifting counterpart curved surface 23 is lowered in the described manner in the embodiment example according to FIG. 9. This slide-on rising edge of the auxiliary cam 57 is designated with 59 and the falling-off edge with 60. Apart from that, the edge 61 in FIG. 9 extending in a oblique manner has to be relatively short, in relation to for instance the embodiment example in FIG. 1. Similarly as in FIG. 1 an approximately flat segment 62 follows upon the obliquely extending edge 61 of the bayonet curved surface 5, which segment 62 extends up to the auxiliary cam 57 wherein this last-mentioned cam transits into the groove mouth 25.

Figure 10:
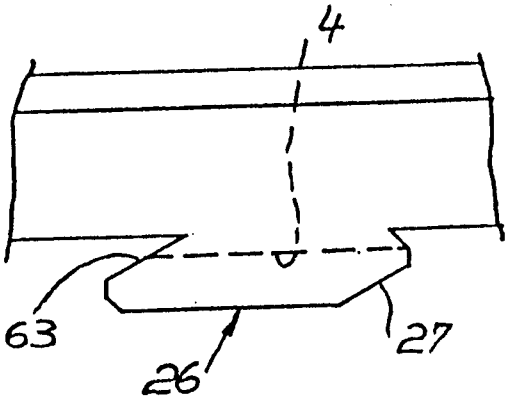
FIG. 10 is a detail of a radiator cap in the region of its bayonet cam that cooperates with the neck portion shown in FIG. 9.

In order to make possible the displacement motion of the bayonet cams 5 and of the counterpart cams 26 in external grooves fashioned in such a manner, the element of the radiator cap 1 formed by these two cams must be given an appropriate shaping. As shown in FIG. 10, a rearward bevel 63 is of particular significance, which is located at the rearward end, viewed from the opening direction 58, of the counterpart cam 26 or of this element. It extends preferably approximately parallel to the slide-on counter bevel 27 of the counterpart cam 26.

While the invention has been described in connection with preferred embodiments, it will be understood that modifications thereof within the principles outlined above will be evident to those skilled in the art and thus the invention is not limited to the preferred embodiments but is intended to encompass such modifications.

I claim:

1. In combination:

(a) a radiator cap comprising a pressure relief valve, a vacuum relief valve, at least inner and outer sealing rings of which at least the inner sealing is an O-ring having a circular cross-section;

(b) a radiator neck having a radial outlet aperture for receiving the radiator cap and cooperating therewith to form a first open position wherein the cap can be lifted off and removed from the radiator neck, a second intermediate closed position wherein excess radiator pressure can be relieved via the radial outlet aperture, and a third completely closed end position wherein the radiator cap is sealed to the neck and the radial outlet aperture is located between the inner and outer sealing rings;

(c) a bayonet-type lock for rotationally connecting the cap to the neck by rotating the cap in a closing direction about an axis from its first position to its second position and thence to its third position and for removing the cap by rotating the cap in an opening direction opposite to the closing direction, said bayonet lock comprising cam surface means for producing a lifting force on the cap to unseal it from the neck when the cap is rotated from its third position toward its first position.

2. In combination:

(a) a radiator cap comprising a pressure relief valve, a vacuum relief valve, at least inner and outer sealing rings of which at least the inner sealing is an O-ring having a circular cross-section;

(b) a radiator neck having a radial outlet aperture for receiving the radiator cap and cooperating therewith to form a first open position wherein the cap can be lifted off and removed from the radiator neck, a second intermediate closed position wherein excess radiator pressure can be relieved via the radial outlet aperture, and a third completely closed end position wherein the radiator cap is sealed to the neck and the radial outlet aperture is located between the inner and outer sealing rings;

(c) a bayonet-type lock for rotationally connecting the cap to the neck by rotating the cap in a closing direction about an axis from its first position to its second position and thence to its third position and for removing the cap by rotating the cap in an opening direction opposite to the closing direction, said bayonet lock comprising on the cap both a bayonet cam and a counterpart cam, and on the neck axially-spaced and opposed a bayonet cam engaging curved surface and a counterpart cam engaging lifting curved surface configured such that the counterpart cam of the cap engages the lifting curved surface when the cap is rotated in an opening direction to produce a cap-lifting action which helps unseal the cap from the neck.

3. The combination of claim 2, wherein the radiator neck comprises a common rotary step terminating the opposed cam engaging and lifting curved surfaces.

4. The combination of claim 3, wherein the opposed cam engaging surfaces form an outer groove extending in a circumferential direction of the neck and which opens outwardly in a radial direction of the neck and discharges axially at a mouth to the outside at a free end of the neck, said mouth having a width, viewed in a circumferential direction, which corresponds at least to the length of the bayonet cam and the counterpart cam.

5. The combination of claim 4, wherein the bayonet cam engaging surface on the neck comprises an inclined edge extending at an angle to a neck mouth plane, and the lifting curved surface consists essentially of first and second approximately flat segments and inner and outer lifting segments rising towards the free neck end, the outer lifting segment extending approximately up the the free neck end and the first approximately flat segment is located between the rotary end stop and the inner lifting segment, axial spacing of the opposed bayonet cam engaging and lifting curved surfaces corresponding at least to the axial spacing of the bayonet cam and the counterpart cam.

6. The combination of claim 5, wherein the bayonet cam engaging surface on the neck comprises two curved surfaces of which an inner end of one of said two curved surfaces extends up to approximately a beginning of the lifting curved surface associated with the other of said two curved surfaces.

7. The combination of claim 5, wherein the counterpart cam viewed in the opening direction comprises at least at its front end a slide-on incline adjacent an approximately flat segment directed toward the neck.

8. The combination of claim 7, wherein the slide-on incline has a slope approximately equal to that of a rising portion of the inner and outer lifting segments on the neck.

9. The combination of claim 7-, wherein the slide-on incline of the counterpart cam is configured to slide along the inner lifting segment of the lifting curved surface, and the radial outlet aperture of the radiator neck is connected internally with a radiator so as to permit flow therebetween.

10. The combination of claim 2, said cap further comprising a centering lug fabricated from plastics having at least one radial passage aperture, in which centering lug the pressure relief valve and the vacuum relief valve are located, said centering lug comprising in the region of its free end a first outer receiving groove for a first O-ring, and a second receiving groove for a second O-ring located so as to be spaced axially from the first receiving groove, and the radial passage aperture is arranged between the two receiving grooves.

11. The combination of claim 10, wherein the radiator neck has an inner wall that is slightly widened outwards conically in a region of the first and second O-rings.

12. The combination of claim 10, wherein the radiator neck has an inner wall that is slightly widened outwards in a step-like manner so that when the cap is in the third position a step is located between the first and second O-rings.

13. The combination of claim 2, wherein the radiator neck at least in a region of the counterpart cam and an upper portion of the radiator cap with the bayonet cam are fabricated from plastics material, a portion of the radiator neck comprising the lifting curved surface is located at a portion of a reservoir of a radiator system also fabricated of plastics material.

14. The combination of claim 13, wherein of the radiator neck has an inner portion fabricated in one piece with the reservoir portion from plastics material.

15. The combination of claim 14, wherein the radiator neck has an outer portion comprising the bayonet cam engaged curved surface which is fabricated separately and is sealed with the inner portion, the outer portion of the radiator neck being fabricated of plastics and being permanently sealed with the inner portion.

16. The combination of claim 14, wherein the radiator neck has an outer portion comprising the bayonet cam engaging curved surface which is fabricated separately and is sealed with the inner portion, the outer portion of the radiator neck being fabricated from metal and being permanently sealed with the inner portion by beading or flanging.

17. The combination of claim 14, wherein the entire radiator is fabricated in one piece with at least an upper portion of the reservoir.

18. The combination of claim 2, further comprising a valve disk on the radiator cap, and a valve seat on the radiator neck, the valve disk and the valve seat forming the pressure relief valve.

19. The combination of claim 2, wherein the radiator cap further comprises a centering lug serving as a valve housing and supported at an upper portion of the cap with the bayonet cam and the counterpart cam so as to be rotatable around the axis.

20. The combination of claim 5, wherein the bayonet cam engaging curved surface on the neck comprises an auxiliary cam facing inside of the neck and located axially opposite the second approximately flat segment of the lifting counterpart curve surface.

21. The combination of claim 5, wherein the first flat segment of the lifting counterpart curve surface forms one of two flanks of a cam-like lifting element facing the free neck end, the other flank falling off towards the second flat segment.

22. The combination of claim 21, wherein the first and second flat segments of the lifting counterpart curved surface lie approximately in the same plane.

23. The combination of claim 22, wherein the bayonet engaging curved surface on the neck comprises an approximately flat segment lying opposite to the cam-like lifting element of the lifting counterpart curved surface, said flat segment extending from its auxiliary cam up to an edge extending in an inclined manner.

24. The combination of claim 7, wherein the counterpart cam transits into a rearward bevel at its rear end in the opening direction, said bevel extending approximately parallel to its cooperating slide-on incline.

25. The combination of claim 2, wherein the cap comprises plural bayonet cams and plural counterpart cams.

* * * * *